United States Patent [19]

Stevens et al.

[11] 3,992,739

[45] Nov. 23, 1976

[54] WATER SAFETY DEVICE

[76] Inventors: Daryl A. Stevens, 610 N. 10th St.; Russell D. Wicktor, Rte. 3, both of Princeton, Minn. 55371

[22] Filed: May 27, 1975

[21] Appl. No.: 580,903

[52] U.S. Cl. ..... 9/14

[51] Int. Cl.[2] ..... B63C 9/00

[58] Field of Search ..... 9/11 A, 13, 14, 2 A; 114/61

[56] References Cited

UNITED STATES PATENTS

| | | | |
|---|---|---|---|
| 2,444,859 | 7/1948 | Sturtevant | 9/2 A |
| 2,456,637 | 12/1948 | Kearny | 9/11 A |
| 3,425,071 | 2/1969 | Frieder, et al. | 9/11 A |
| 3,846,858 | 2/1972 | Syfritt | 114/61 X |

*Primary Examiner*—Trygve M. Blix
*Assistant Examiner*—Sherman D. Basinger
*Attorney, Agent, or Firm*—Burd, Braddock & Bartz

[57] ABSTRACT

An inflatable water flotation device for remote rescue of a victim in peril of drowning. The device comprises an elongate, closed tubular member constructed of a flexible, air impervious material permitting compact folding and storage of the device in a deflated configuration. The elongate tubular member is stored in a compact, water tight case. Upon inflation by a gas, the tubular member is deployable to an elongate, generally linear, semi-rigid tube, one end of which is remotely maneuverable to a distant victim. A self-contained gas supply associated with the device is operable for rapid inflation of the tubular member at time of emergency. A safety line is contiguous with the length of the member and facilitates grasping by the victim to expedite recovery of the victim.

7 Claims, 4 Drawing Figures

WATER SAFETY DEVICE

BACKGROUND OF THE INVENTION

Remote rescue of a victim in peril of drowning by a rescuer is oftentimes more expedient than attempting to reach the victim for person-to-person rescue because it is faster and furthermore, the rescuer himself is not placed in peril of drowning. Various water rescue devices are available which assist in remote rescue of a victim in peril of drowning. For example, the common ring-type life buoy having an attached rope may be thrown to the victim while an end of the rope is retained by the rescuer. Accuracy of the throw is important as, once thrown, the location of the ring buoy cannot be adjusted by the rescuer except by pulling inwardly. Many rescue devices are inflatable and, when maintained ready for emergencies, are kept in the inflated state to eliminate the time factor required for inflation. If such devices are thrown to the victim, the accuracy of the throw is again important. Various elongate sticks or poles or the like which are used to extend to a drowning victim are heavy, difficult to store and cumbersome to use. Typically, such elongate poles are rigid and do not provide any measure of flexibility.

SUMMARY OF THE INVENTION

The invention relates to an inflatable, water flotation device usable to effect the rescue of a victim in peril of drowning. The device is light, inexpensive and readily transportable. The device includes an elongate, inflatable tubular member which is foldable in a compact bundle in a deflated configuration for storage in a water tight, floatable case. In the unfolded, inflated configuration, the tubular member provides an elongate, generally linear tube which is semi-rigid. The tube is extendable to a victim in peril of drowning. The extended end of the tube is easily maneuvered at the restrained end to reach the victim. The tube may be extended over water or ice. A safety line is contiguous with the length of the tube and can be grasped by the victim. Means are provided on the tubular member for the rapid inflation and deployment of the member. A compressed gas cartridge communicates with the interior of the tubular member through a releasable valve assembly. To deploy the tubular member, the valve release is actuated and expanding gas flows into the tubular member and rapidly inflates it. Inflation is accomplished in a matter of seconds and the tubular member is ready to deploy to a victim. The device is reusable.

IN THE DRAWINGS

DESCRIPTION OF PREFERRED EMBODIMENTS

Figure 1:
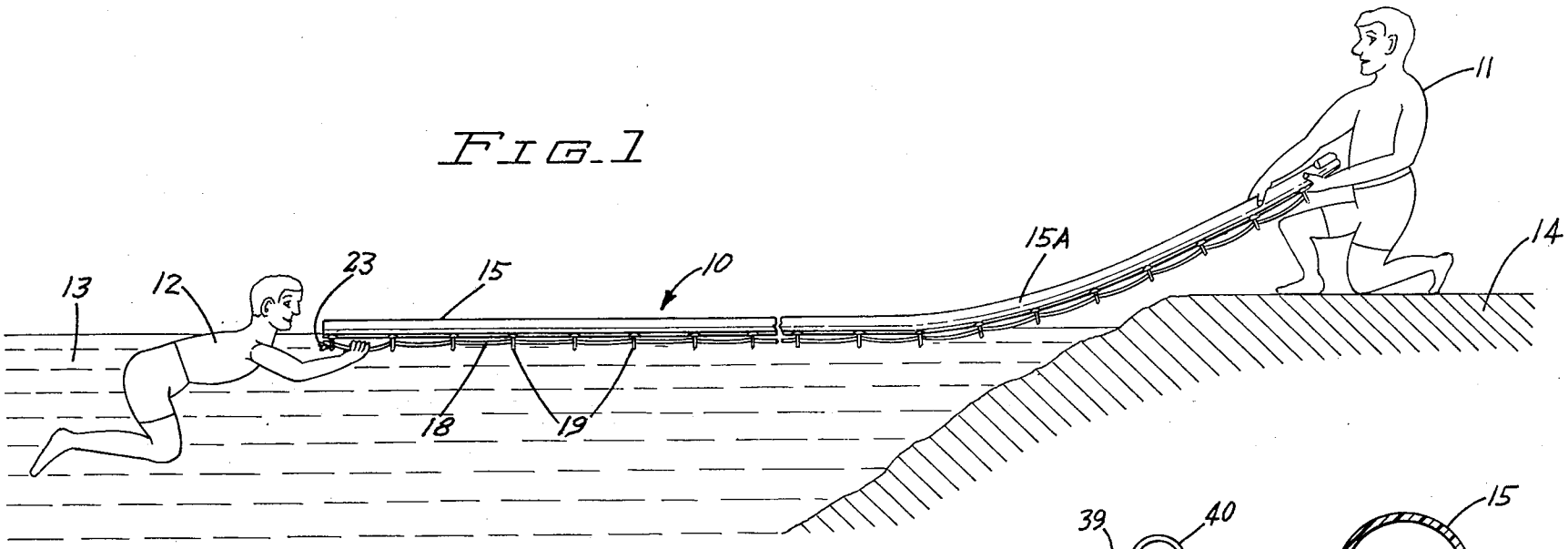
FIG. 1 is a schematic illustration of the water safety device of the invention in use with a rescuer having extended the device to an imperiled victim in the water.

Referring to the drawings, there is shown in FIG. 1 the water safety device of the invention, indicated generally at 10, in use by a rescuer person 11 to rescue an imperiled victim 12 in a body of water 13 such as a lake, river, pond, pool or the like. Rescuer person 11 is located safely on a shore 14 and is effecting a remote rescue of victim 12. Rescue person 11 is safe from danger but is able to manipulate safely and easily the safety device 10 for grasping by imperiled victim 12 to pull victim 12 toward shore.

Safety device 10 includes an elongate, tubular member 15 closed and sealed at both ends so as to be capable of containing an expanded gas within elongated chamber 16 of tubular member 15 such as air or carbon dioxide, in the inflated configuration of FIG. 1. Tubular member 15 can be constructed of sheet like material such as vinyl, plastic, sealed canvas, or other like material being durable, light and air impervious. Tubular member 15 is inflatable, as shown in FIG. 1, and floats on top of the water. In the inflated configuration, tubular member 15 has a semi-rigid characteristic, having a generally linear natural axis but being bendable as shown at 15A in FIG. 1 where tubular member 15 bends upwardly toward rescuer person 11. The semi-rigid characteristic of the tubular member 15 enables remote directioning and locating of the outward end by manipulation of the inward end, akin to manipulation of a rigid pole. The outboard end is readily directable to an imperiled victim in the water or, in like manner, is readily directable over thin ice to an imperiled victim having fallen through, without endangering the rescuer. Tubular member 15 is of a suitable length to be extended outward over the water to a victim, and can be approximately 50 feet in length as most accidents or such emergencies occur within 50 feet of a shoreline, a dock, low water or other safe location from which to deploy the safety device.

A safety line 18 is coextensive with the length of tubular member 15 adapted to be grasped by imperiled victim 12 when being assisted to shore. Safety line 18 can be any variety of strong rope, cord or the like and in general will have a tensile strength greater than that of tubular member 15 thus to be able to withstand a greater tensile loading than tubular member 15. Safety line 18 is affixed relative to tubular member 15 by passing through a plurality of spaced apart eyelets 19 attached to the side wall of tubular member 15.

Figure 3:
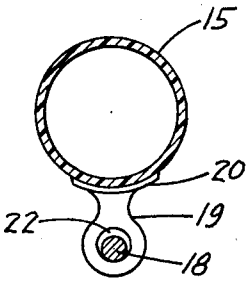
FIG. 3 is a sectional view of the safety device of FIG. 2 taken along the line 3—3 thereof.
Figure 2:
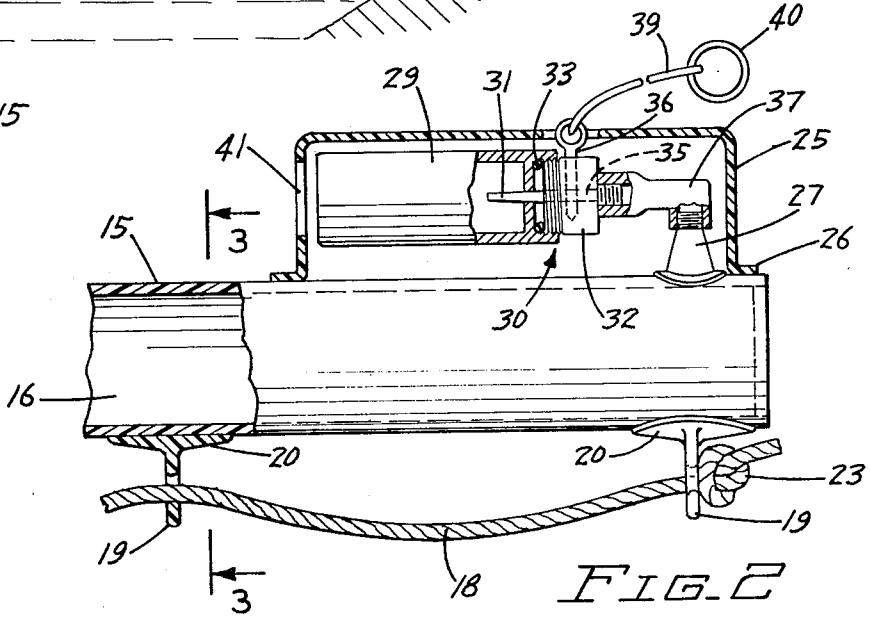
FIG. 2 is an enlarged view of the end of the safety device of FIG. 1 with portions broken away from purposes of illustration.

Referring to FIG. 3, each eyelet 19 has a base 20 suitably contoured to conform to the curvature of tubular member 15. Base 20 is affixed tubular member 15 by suitable means such as adhesive bonding. An eye 22 formed in eyelet 19 accommodates the safety line 18. As shown in FIG. 1, a plurality of the eyelets 19 are spaced apart along the length of tubular member 15 to accommodate safety line 18. As shown in FIG. 2, safety line 18 is retained in assembled relationship relative to the opposite end eyelets 19 as by having knots 23 affixed in the ends thereof. Other types of connecting structures can be used to attach line 18 to tubular member 15. Safety line 18 may comprise one, two or more cords coextensive with the length of tubular member 15.

Figure 4:
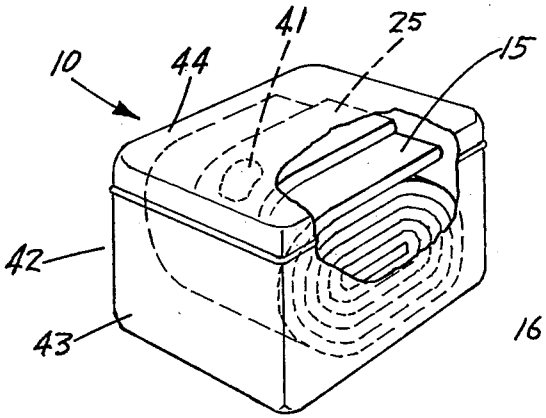
FIG. 4 is a perspective view partly broken away showing the safety device of the invention in storage configuration within a storage container.

In a deflated configuration, tubular member 15 is folded or rolled into a compact, light and readily transportable or storable bundle as shown in FIG. 4. An important feature of the safety device 10 is the capability to be quickly and simply deployed from the compact, storage configuration to the rescue configuration of FIG. 1. Deployment is accomplished within a matter of seconds thus to safe valuable time upon the occurrence of an emergency.

Referring to FIG. 2, an end of tubular member 15 is provided with a pouch 25 which can be of the same material as tubular member 15 and can be bonded to tubular member 15 along the lower edges 26 of pouch 25. A self-contained compressed gas supply is stored within the confines of pouch 25. A valve stem 27 communicates with the interior of tubular member 15. A compressed gas supply cartridge 29 is operatively associated with valve stem 27 to accomplish rapid inflation of tubular member 15 upon deployment. Compressed gas cartridge 29 contains any suitable, expandable gas such as carbon dioxide, air or the like. A valve 30 is connected between compressed gas cartridge 29 and valve stem 27 for selective inflation of tubular member 15 by expanding gas derived from cartridge 29. Cartridge 29 and valve 30 can be of any of numerous suitably constructed valve and cartridge combinations commercially available. As shown, valve 30 is a needle valve having a needle 31 penetrating cartridge 30. Needle 31 extends from a valve body 32 threadably engaged at one end of cartridge 29 in sealing relationship to an O-ring 33. A linear passage 35 through valve body 32 communicates with needle 31 and is closed by a pin 36 orientated generally in perpendicular relationship to the axis of passage 35. A connector 37 extends from the outboard end of passage 35 on valve body 32 to the inlet of valve stem 27. Pin 36 is positioned with respect to the passage 35 to block the flow of expanding gas from the cartridge 29. Pin 36 is connected to a pull cord 39 having a pull ring 40 at its opposite end. Sufficient pulling force exerted upon the ring 40 or the pull cord 39 is operative to displace pin 36 from passage 35. This permits a rapid flow of expanding gas from cartridge 29 into tubular member 15 for inflation and deployment thereof. An opening 41 is provided in pouch 25 for access to the interior thereof to replace an expended compressed gas cartridge 29 for continued reuse of water safety device 10.

As shown in FIG. 4, water safety device 10 includes a compact case 42 having a four-sided housing 43 with a closed bottom and an open, accessible top closed by a removable cover 44. Case 42 is formed preferably of a floatable, weather resistant, expanded foam plastic. Cover 44 fits in watertight engagement with respect to the upper edges of housing 43. In the deflated, folded and bundled configuration shown in FIG. 4, tubular member 15 fits snugly within housing 43 covered by the cover 44. Additional or replacement gas cartridges may also be contained in case 42. Case 42 is compact and may be stored under the seat of a boat, near a dock or lifeguard station, or the like.

In use, water safety device 10 is maintained in a stored but prepared state of FIG. 4 in a boat, by a dock or the like. When an emergency occurs and a potential victim is imperiled in the water, tubular member 15 in the folded form is quickly removed from case 42. Pull ring 40 is engaged and pulled to initiate the expanding flow of gas from compressed gas cartridge 29 to tubular member 15. Gas rapidly exits the cartridge 29 to fill tubular member 15 in a matter of seconds. Within a short period of time, tubular member 15 is deployed in an elongate, semi-rigid configuration of FIG. 1. Tubular member 15 may be deployed in such a fashion that it expands in the direction of the imperiled victim. In any event, after expansion, the outward end of tubular member 15 is quickly maneuvered to the victim. The victim grasps tubular member 15 or safety line 18 and is pulled to safety. Tubular member 15, being inflated, offers a measure of buoyancy itself. During the rescue operation, the rescuer is not imperiled but performs the operation from a safe location.

After the rescue operation is complete, tubular member 15 is deflated by removal of expended gas cartridge 29 to allow release of gas through needle 31. The gas cartridge 29 is then replaced with a fresh cartridge. In the deflated configuration, the tubular member 15 is folded and stored, again ready for use in the event of an emergency.

The embodiments of the invention in which an exclusive property or privilege is claimed are defined as follows:

1. A water safety device to enable a rescuer person to lend assistance to an imperiled victim comprising:

a single elongated linear cylindrical tube having closed and sealed ends as a linear continuation of said tube adapted to be inflated with a gas to form a longitudinal linear semi-rigid elongate, floatable tube, said tube being bendable about a generally linear natural axis, said tube having a first end that, when inflated, can be maneuvered toward an imperiled victim in the water and a second end that can be manipulated by a rescuer person for maneuvering the first end, said inflated tube having a diameter dimension of a size to be readily grasped by a rescuer person and an imperiled victim, said tube being deflatable for rolling into a compact bundle;

a pouch located on the tube near and inwardly of the second end thereof;

a compressed gas supply cartridge located in the pouch, means connecting the cartridge to the tube for carrying gas from the cartridge to the tube for inflation of the tube;

releasable valve means associated with said compressed gas supply cartridge for selective release of compressed gas from the gas supply means to the tube by a rescuer person while holding said second end for inflating of the tube to form said semi-rigid, longitudinal, elongate tube; and a safety line extending the length of the tube and means fastening said safety line to the tube so that the safety line can be grasped by an imperiled victim.

2. The water safety device of claim 1 wherein: the means for attaching the line means to the tube includes a plurality of eyelets spaced apart along the length of said elongate tube, each eyelet having an eye, said line means being threaded through the eyes of said eyelets.

3. The water safety device of claim 2 wherein: each said eyelet has a base in substantial conformity to a portion of the surface of said tube, said base being bonded to said tube.

4. The water safety device of claim 1 including: pull cord means associated with said valve means to release said valve means and permit flow of gas from the cartridge to the tube.

5. The water safety device of claim 1 including: a case having a housing with side walls and a bottom of a size to contain said tube in the deflated and folded configuration, and cover means to cover the top of the housing and make water tight engagement with said housing.

6. A water safety device to enable a rescuer person to lend assistance to an imperiled victim, comprising: a single longitudinal, linear, cylindrical tube formed of a flexible air impervious material, said tube having a first closed end and a second closed end both as linear continuations of said tube, said tube being inflatable with a gas to a normally substantial longitudinal, linear length and cylindrical configuration for extension of said first end to an imperiled victim in water by a rescuer person manipulating said second end, and deflatable for folding into a compact bundle;

safety line means coextensive with the length of the tube and fastened at said first and second ends thereof so to be grasped by an imperiled victim in the water, said tube when inflated with a gas having a diameter dimension of a size to be readily grasped by a rescuer person and an imperiled victim;

a plurality of eyelets fastened to said tube along the longitudinal length thereof, each eyelet having an eye, said safety line means being trained through the eyes of the eyelets;

a cartridge for storing compressed gas, means connecting the cartridge to said tube near and inwardly of the second end thereof for carrying gas from the cartridge to the tube to inflate said tube;

valve means associated with the cartridge of compressed gas operable by a rescuer person holding the second end of said tube to permit release of the gas from the cartridge to inflate the tube; and, a means for actuation of the valve means by the rescuer person whereby the tube is inflated with gas from the cartridge and longitudinally elongated.

7. The water safety device of claim 6 including: housing means adapted to contain said tube in the deflated, folded configuration, said housing means including a housing and cover means for the housing, said cover means being engageable with said housing in water tight relationship.

* * * * *